US012000121B2

(12) United States Patent
Li et al.

(10) Patent No.: US 12,000,121 B2
(45) Date of Patent: Jun. 4, 2024

(54) WATER CONSERVATION SYSTEM

(71) Applicants: Elizabeth Li, Superior Township, MI (US); Catherine Li, Superior Township, MI (US)

(72) Inventors: Elizabeth Li, Superior Township, MI (US); Catherine Li, Superior Township, MI (US)

( * ) Notice: Subject to any disclaimer, the term of this patent is extended or adjusted under 35 U.S.C. 154(b) by 241 days.

(21) Appl. No.: 17/231,753

(22) Filed: Apr. 15, 2021

(65) Prior Publication Data

US 2022/0333359 A1 Oct. 20, 2022

(51) Int. Cl.

| | |
|---|---|
| ***E03B 1/04*** | (2006.01) |
| ***E03B 7/04*** | (2006.01) |
| ***E03C 1/02*** | (2006.01) |
| ***E03C 1/04*** | (2006.01) |

(52) U.S. Cl.

CPC ..... *E03B 1/048* (2013.01); *E03B 7/045* (2013.01); *E03C 1/023* (2013.01); *E03C 1/0408* (2013.01); *E03C 2201/30* (2013.01)

(58) Field of Classification Search

CPC ..... E03B 1/048; E03B 7/045; E03C 1/0408; E03C 1/023; E03C 2201/30

See application file for complete search history.

(56) References Cited

U.S. PATENT DOCUMENTS 5,564,462 A * 10/1996 Storch ..... F24D 17/0078 122/13.3
5,913,614 A * 6/1999 Smith ..... E03B 1/04 236/12.12
9,074,356 B2 * 7/2015 Tarantino ..... E03B 1/048
2009/0293961 A1 * 12/2009 McMurtry ..... E03B 1/048 137/337

FOREIGN PATENT DOCUMENTS

WO WO-2011004044 A2 * 1/2011 ..... E03B 1/04
WO WO-2019018862 A1 * 1/2019

* cited by examiner

*Primary Examiner* — Atif H Chaudry
(74) *Attorney, Agent, or Firm* — Howard & Howard Attorneys PLLC

(57) ABSTRACT

A water conservation system includes a showerhead, a water conservation tank, and a sensor. The system further includes a first valve configured to direct water towards the conservation water tank in an open position and configured to prevent water from flowing towards the conservation water tank when in a closed position. The system further includes a second valve configured to direct water towards the showerhead in an open position and configured to prevent water from reaching the showerhead in a closed position. A controller is configured to direct the first valve to the open position and the second valve to the closed position upon the detection of water flow by the sensor and the configured to direct the first valve to the closed position and the second valve to open position upon the occurrence of an event that occurs after the initial detection of water flow by the sensor.

11 Claims, 3 Drawing Sheets

WATER CONSERVATION SYSTEM

FIELD OF THE DISCLOSURE

The following disclosure is generally directed to a water conservation system for conserving water while showering.

BACKGROUND OF THE DISCLOSURE

Water conservation is the practice of using water efficiently to reduce unnecessary water usage. Conventional water conservation systems typically conserve shower water by reducing the volume of water exiting the showerhead (e.g., by aerating). However, even when the volume of water is reduced, the operator of the shower typically intentionally "wastes" a first portion of water exiting the showerhead for the purpose of allowing the water to reach a desired temperature. Accordingly, there remains a need to develop a water conservation system that reduces or eliminates water intentionally wasted by the operator.

SUMMARY OF THE DISCLOSURE AND ADVANTAGES

The following disclosure provides a water conservation system for use with a shower. The system includes a showerhead having a first elevation. The system also includes a main water supply tank for supplying water to the system. The system further includes a conservation water tank that is separate from the main water supply tank. The conservation water tank is located at a second elevation, which is lower than the first elevation. The system further includes a water supply line fluidly coupled with the main water supply tank, with the water supply line comprising a pipe portion extending between the showerhead at the first elevation and the conservation water tank at the second elevation such that the pipe portion is arranged to facilitate the flow of water to the conservation tank. The system further includes a sensor positioned along the water supply line between the showerhead and the main supply tank to detect the flow of water. The system further includes a first valve (NC) having an open position and a closed position, with the first valve configured to direct water towards the conservation water tank in the open position and configured to prevent water from flowing towards the conservation water tank when in the closed position. The system further includes a second valve (NO) having an open position and a closed position, with the second valve configured to direct water towards the showerhead in the open position and configured to prevent water from reaching the showerhead in the closed position. The system further includes a controller electrically coupled to the sensor and configured to operate the first and second valve. The system further includes a manual user input configured to initiate the flow of water from the main water supply tank. The controller is configured to direct the first valve to the open position and the second valve to the closed position upon the detection of water flow by the sensor and configured to direct the first valve to the closed position and the second valve to open position upon the occurrence of an event that occurs after the initial detection of water flow by the sensor. The system is configured to collect water in the conservation tank until the occurrence of the event and configured to expel water from the showerhead after the occurrence of the event.

BRIEF DESCRIPTION OF THE DRAWINGS

Advantages of the present disclosure will be readily appreciated as the same becomes better understood by reference to the following detailed description when considered in connection with the accompanying drawings.

None of the Figures are drawn to scale.

DETAILED DESCRIPTION

The following disclosure is directed to a water conservation system 10 for a shower. The water conservation system 10 is designed to reduce or eliminate purposeful water waste. For the purposes of this disclosure, "purposeful water waste" means water that this expelled from a shower but is undesirable to a user or bather and therefore intentionally wasted by the user. For example, the user may take a shower and activate the shower by operating the shower faucet. However, often the temperature of the water first expelled from the showerhead 12 is not desirable to the user and the user intentionally allows this initial quantity of water to pass to the drain without actually utilizing the water to wash their body. This water that is allowed to pass to the drain is purposeful water waste.

Figure 1:
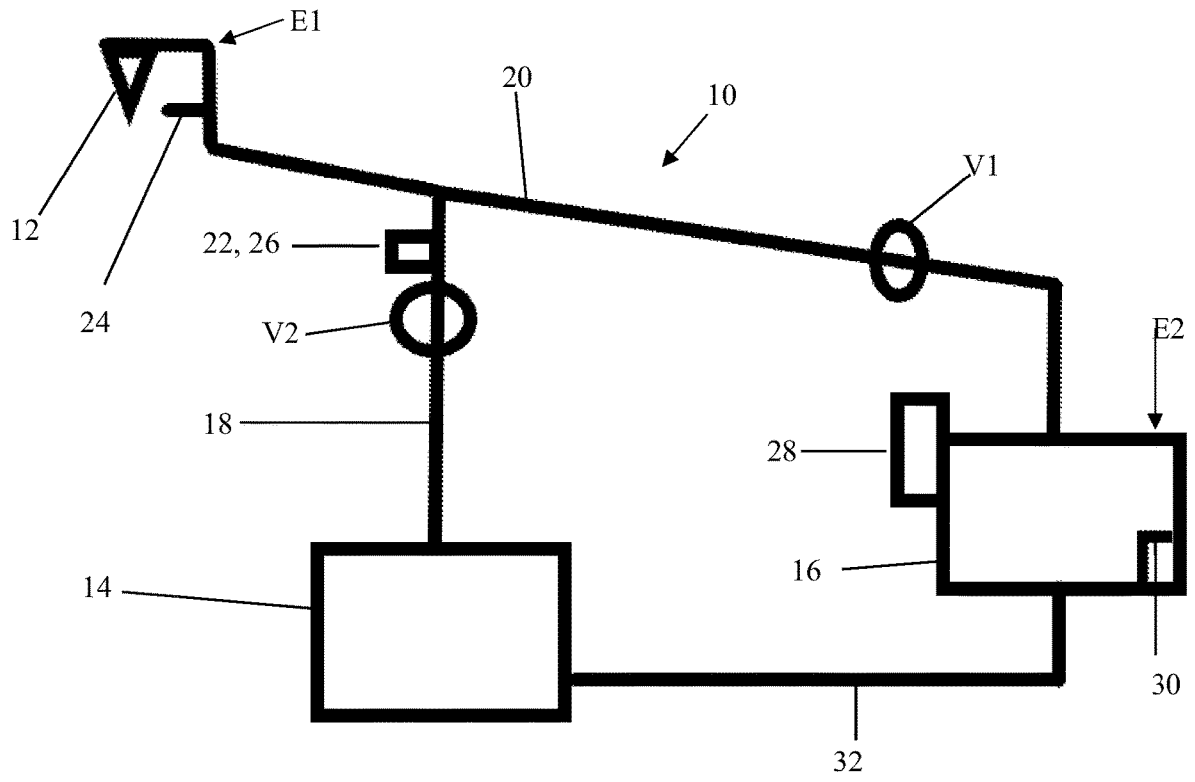
FIG. 1 is a schematic representation of the water conservation system.

With reference to FIG. 1, the water conservation system 10 includes a showerhead 12. The configuration of the showerhead 12 is not limited. Any commercially available showerhead 12 may be used in the water conservation system 10. The showerhead 12 is located at a first elevation E1 and is typically fixed to a wall of a shower. The water conservation system 10 also includes a main water supply tank 14 for supplying water to the water conservation system 10. The main water supply tank 14 may be more commonly referred to as a hot water tank.

The water conservation system 10 also includes a conservation water tank 16 separate from the main water supply tank 14. The conservation water tank 16 is not limited to any particular geometry and the size of the conservation water tank 16 is such that the tank is capable of holding at least 1 gallon of water. More typically the conservation water tank 16 is dimensioned to hold from 1 to 100 gallons of water. Even more typically, the conservation water tank 16 is dimensioned to hold from 1 to 50 gallons of water. However, this disclosure contemplates an even larger size conservation water tank 16, which may be more commonly used in commercial settings that include multiple showers, such as athletic facilities, hotels, or hospitals. The conservation water tank 16 is located at a second elevation E2 that is lower than the first elevation E1. In other words, in the water conservation system 10, the conservation water tank 16 is located or positioned at an elevation that is below the elevation of the showerhead 12, but is not necessarily located directly below the showerhead 12.

The water conservation system 10 also includes a water supply line 18 fluidly coupled with the main water supply tank 14. The water supply line 18 provides a conduit for water to flow from the main water supply tank 14 to the showerhead 12. The water supply line 18 also comprises a pipe portion 20 extending between the showerhead 12 at the first elevation E1 and the conservation water tank 16 at the second elevation E2 such that the pipe portion 20 is arranged to facilitate a gravity based flow of water from the showerhead 12 to the conservation water tank 16. In other words, the pipe portion 20 generally runs downhill from the showerhead 12 to the conservation water tank 16. In certain embodiments, the entire pipe portion 20 extends downhill from the showerhead 12 to the conservation water tank 16. It is to be appreciated that both the water supply line 18 and the pipe portion 20 may be formed of any suitable material including, but not limited to, PVC, engineered plastics, metal such as copper, etc.

The water conservation system 10 also includes a sensor 22 positioned along the water supply line 18 between the showerhead 12 and the main water supply tank 14 to detect the flow of water. Typically, the sensor 22 is referred to as a flow sensor 22. The sensor 22 is capable of determining whether water is flowing through the water conservation system 10.

The water conservation system 10 also includes a first valve V1. Typically, the first valve V1 is located along the pipe portion 20 between the showerhead 12 and the conservation water tank 16. The first valve V1 has an open position (OP) and a closed position (CP). When the first valve V1 is in the open position (OP), the first valve V1 is configured to direct water towards the conservation water tank 16. In contrast, when the first valve V1 is in the closed position (CP) the first valve V1 is configured to prevent water from flowing towards the conservation water tank 16. In other words, when the first valve V1 is in the closed position (CP), water is precluded from reaching the conservation water tank 16.

The water conservation system 10 also includes a second valve V2 (NO) having an open position (OP) and a closed position (CP). When the second valve V2 is in the open position (OP), the second valve V2 is configured to allow water to flow towards the showerhead 12. When the second valve V2 is in the closed position (CP), the second valve V2 is configured to prevent water from reaching the showerhead 12. In addition, when the second valve V2 is in the closed position (CP), the second valve V2 also prevents water from draining back into the main water supply tank 14.

The water conservation system 10 further includes a user input 24 configured to initiate the flow of water from the main water supply tank 14. The user input 24 is most commonly referred to as a shower handle or temperature control knob, etc. Or said differently, the user input 24 is the mechanical hardware that the user grasps to start the flow of water and stop the flow of water, which may also be used to adjust the temperature of the water.

The water conservation system 10 further includes a controller 26 that communicates with the sensor 22 and is configured to operate the first and second valves V1, V2. The controller 26 may be mounted to the sensor 22 or positioned apart from the sensor 22. The controller 26 is configured to direct the first valve V1 to the open position (OP) and the second valve V2 to the closed position (CP) upon the detection of water flow by the sensor 22 and configured to direct the first valve V1 to the closed position (CP) and the second valve V2 to the open position (OP) upon the occurrence of an event that occurs after the initial detection of water flow by the sensor 22. When the water conservation system 10 functions to conserve water, the first valve V1 is in the open position (OP) and the second valve V2 is in the closed position (CP). After the desired quantity of water is conserved, the water conservation system 10 functions to allow the user to shower normally by directing the first valve V1 to the closed position (CP) and the second valve V2 to the open position (OP). It should also be appreciated that for the purposes of this disclosure, when the controller 26 "directs" a valve to a position, if the valve is already in the desired position, the direction from the controller 26 will maintain the position of the valve. In other words, for the controller 26 to direct the position of a valve does not require the controller 26 to move the position of the valve if the valve is already in the desired position. Still further, it is to be appreciated that the controller 26 is not required to immediately direct the position of the valves upon the detection of water or the occurrence of the event. For example, it may be desirable for the controller 26 to delay the direction of the valve to a desired position, such as allowing the previous valve positions to remain for a few seconds after the detection of the flow of water or the occurrence of the event.

For the purpose of this disclosure, the event is not particularly limited. For example, the event may be the passage of a certain amount of time. For example, when the event is 30 seconds, the controller 26 may direct the first valve V1 to the open position (OP) and the second valve V2 to the closed position (CP) for thirty seconds and then direct the first valve V1 to the closed position (CP) and the second valve V2 to the open position (OP). As another example, the event may also be defined as the point in which the water flowing through the water conservation system 10 reaches a certain temperature (e.g., 80° F.). The water conservation system 10 is configured to collect water in the conservation water tank 16 until the occurrence of the event and configured to expel water from the showerhead 12 after the occurrence of the event.

Figure 2:
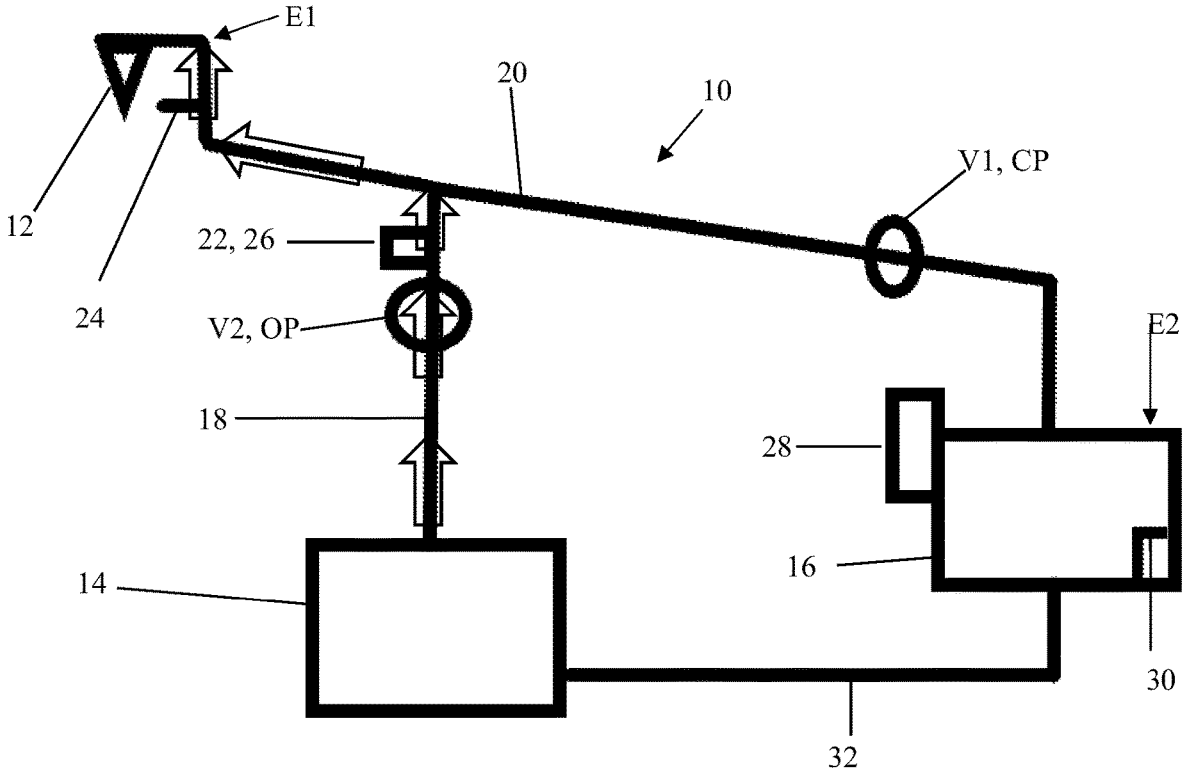
FIG. 2 is a schematic representation of the water conservation system showing the flow of water when a first valve is in the closed position and the second valve is in the open position.
Figure 3:
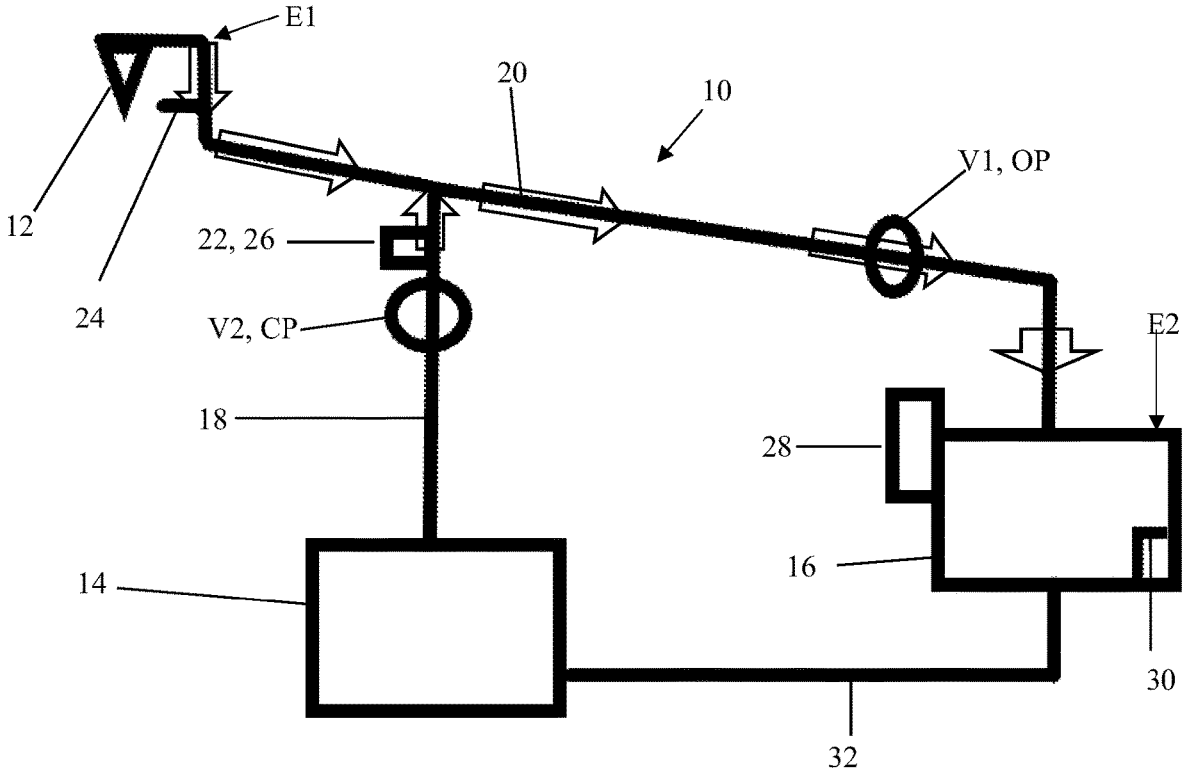
FIG. 3 is a schematic representation of the water conservation system showing the flow of water when a first valve is in the open position and the second valve is in the closed position.

Referring now to FIGS. 2 and 3, as an illustrative example of the operation of the water conservation system 10, the user wishing to take a shower engages the user input 24 to initiate the water conservation system 10. Once the user input 24 is initiated by the user, water begins to flow through the water conservation system 10. The sensor 22 detects the flow of water and communicates with the controller 26. The controller 26 then directs the first valve V1 to the open position (OP) and the second valve V2 to the closed position (CP). When the second valve V2 is in the closed position (CP), water is prevented from flowing from the main water supply tank 14 to the showerhead 12. However, because the first valve V1 is in the open position (OP), water is permitted to flow to the conservation water tank 16. Because the user just initiated the shower, the water currently contained within the system is typically at an undesirable temperature. However, because the second valve V2 is closed, the water conservation system 10 is no longer pressurized and the undesirable water is permitted to flow under the force of gravity to the conservation water tank 16. The flow is described as a gravity-based flow because the showerhead 12 is at the first elevation E1 and the conservation water tank 16 is at the second elevation E2, which is lower than the first elevation E1. Accordingly, water flows from the showerhead 12 through the pipe portion 20 to the conservation water tank 16. Thus, in comparison to conventional shower systems, the water conservation system 10 reduces or eliminates purposeful water waste. In other words, rather than allowing cold and therefore undesirable water that is traditionally expelled from a showerhead 12 to a drain without being utilized by the user/bather, the undesirable water is directed to, and captured in, the conservation water tank 16 rather than a drain and therefore not wasted. After the occurrence of an event, e.g., a 5 or 10 or 20 or 30 second time period, the controller 26 directs the second valve V2 to the open position (OP) and the first valve V1 to the closed position (CP), which once again pressurizes the system and redirects the flow of water to the showerhead 12 and prevents water from reaching the conservation water tank 16. However, after the occurrence of the event, the water expelled from the showerhead 12 is desirable because the water is at a desirable temperature and thus is likely to be considered useful and therefore be utilized by the user. Accordingly, the water contained within the water supply line 18 downstream of the second valve V2 is colder when the second valve V2 is in the closed position (CP) as compared to water contained within the same location when the second valve V2 is in the open position (OP). Or said differently, the water directed to the conservation water tank 16 is at a first temperature and the water expelled from the showerhead 12 is at a second temperature, that is greater than the first temperature.

The conservation water tank 16 may also include a second sensor 28 and a pump 30. Although not required, the second sensor and the pump may be included as an integral unit or alternatively may be separate components. The second sensor 28 is configured to determine when the conservation water tank 16 contains a selected volume of water. Most typically, the selected volume of water is the volume of water associated with the conservation water tank 16 being full or sufficiently full as to justify returning the conserved water to the main water supply tank 14. To this end, when the second sensor 28 determines that the conserved water is at the selected volume, the second sensor 28 communicates with a controller to initiate the pump 30, which is configured to pump the conserved water from the conservation water tank 16 to a conduit 32 that directs water to the main water supply tank 14. The controller that communicates with the second sensor 28 may be the same controller 26 that communicates the sensor 22 or may be a different controller (not shown).

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A water conservation system for use with a shower comprising:

a showerhead located at a first elevation;

a main water supply tank for supplying water to the system;

a conservation water tank separate from the main water supply tank, with the conservation water tank located at a second elevation that is lower than the first elevation;

a water supply line fluidly coupled with the main water supply tank, with the water supply line comprising a pipe portion extending between the showerhead at the first elevation and the conservation water tank at the second elevation such that the entire pipe portion is angled downward from the showerhead to the conversation tank to facilitate the flow of water under gravity to the conservation tank;

a sensor positioned along the water supply line between the showerhead and the main supply tank to detect the flow of water;

a first valve (NC) having an open position and a closed position, with the first valve configured to direct water towards the conservation water tank in the open position and configured to prevent water from flowing towards the conservation water tank when in the closed position;

a second valve (NO) having an open position and a closed position, with the second valve configured to direct water towards the showerhead in the open position and configured to prevent water from reaching the showerhead in the closed position;

a controller electrically coupled to the sensor and configured to operate the first and second valve; and a manual user input configured to initiate the flow of water from the main water supply tank;

wherein the controller is configured to direct the first valve to the open position and the second valve to the closed position upon the detection of water flow by the sensor and is configured to direct the first valve to the closed position and the second valve to the open position upon the occurrence of an event that occurs after the initial detection of water flow by the sensor; and wherein the system is configured to direct water to the conservation tank until the occurrence of the event and configured to expel water from the showerhead after the occurrence of the event.

2. The water conservation system of claim 1 wherein water held in the conservation water tank is at a first temperature and water expelled from the showerhead is at a second temperature that is greater than the first temperature.

3. The water conservation system of claim 1 wherein the conservation water tank comprises a second sensor configured to detect when the conservation water tank contains a predetermined volume and further comprises a pump configured to return water held in the conservation water tank to the main water supply tank.

4. The water conservation system of claim 1 wherein the system is pressurized with water when the second valve is in the open position and is not pressured when the second valve is in the closed position.

5. The water conservation system of claim 1 wherein water is precluded from reaching the conservation water tank when the first valve is in the closed position.

6. The water conservation system of claim 1 wherein the flow of water to the conservation water tank that occurs when the first valve is in the open position and the second valve is in the closed position is further defined as a gravity-based flow.

7. The water conservation system of claim 1 wherein water is precluded from flowing through at least a portion of the pipe portion when the first valve is in the closed position.

8. The water conservation system of claim 1 wherein the conservation water tank comprises a second sensor configured to detect when the tank reaches a predetermined volume and further comprises a pump configured to return water held in the conservation water tank to the main water supply tank, and wherein the system is pressurized with water when the second valve is in the open position and is not pressured when the second valve is in the closed position.

9. The water conservation system of claim 8 wherein water is precluded from flowing through at least a portion of the pipe portion when the first valve is in the closed position.

10. The water conservation system of claim 1 wherein water is precluded from reaching the conservation water tank when the first valve is in the closed position and wherein the flow of water to the conservation water tank that occurs when the first valve is in the open position and the second valve is in the closed position is further defined as a gravity-based flow.

11. The water conservation system of claim 10 wherein water is precluded from flowing through at least a portion of the pipe portion when the first valve is in the closed position.

* * * * *